US009592885B2

(12) United States Patent
Harvey

(10) Patent No.: US 9,592,885 B2
(45) Date of Patent: Mar. 14, 2017

(54) TUBESHIPS, AND SYSTEMS AND METHODS OF CONSTRUCTING

(71) Applicant: James F. Harvey, Magnolia, TX (US)

(72) Inventor: James F. Harvey, Magnolia, TX (US)

( * ) Notice: Subject to any disclaimer, the term of this patent is extended or adjusted under 35 U.S.C. 154(b) by 52 days.

(21) Appl. No.: 14/642,612

(22) Filed: Mar. 9, 2015

(65) Prior Publication Data

US 2016/0264215 A1 Sep. 15, 2016

(51) Int. Cl.
*B63B 3/08* (2006.01)
*B63B 3/06* (2006.01)

(52) U.S. Cl.
CPC ..... *B63B 3/06* (2013.01)

(58) Field of Classification Search
CPC ..... B63B 3/06; B63B 3/48
USPC ..... 114/65 R
See application file for complete search history.

(56) References Cited

U.S. PATENT DOCUMENTS

| | | | | |
|---|---|---|---|---|
| 1,980,998 | A | 11/1934 | Knight | |
| 2,030,881 | A | 2/1936 | Knight | |
| 2,560,153 | A | 7/1951 | Blount | |
| 3,083,669 | A | 4/1963 | Bunn | |
| 3,307,513 | A | 3/1967 | Engleman | |
| 3,447,503 | A * | 6/1969 | Myers | B63B 9/00 114/65 R |
| 4,112,775 | A * | 9/1978 | Sylvester | G01N 29/2487 73/627 |
| 5,522,340 | A * | 6/1996 | Skogman | B63B 5/24 114/357 |
| 6,810,828 | B2 | 11/2004 | Maklezow | |
| 7,044,072 | B2 | 5/2006 | Converse et al. | |
| 2013/0068154 | A1 * | 3/2013 | Ophardt | B63B 3/09 114/79 R |

FOREIGN PATENT DOCUMENTS

| | | | |
|---|---|---|---|
| EP | 0053157 | A1 | 6/1982 |
| EP | 0218564 | A1 | 4/1987 |
| GB | 564485 | A | 9/1944 |
| WO | 2005077747 | A1 | 8/2005 |

* cited by examiner

*Primary Examiner* — Stephen Avila
(74) *Attorney, Agent, or Firm* — Norton Rose Fulbright US LLP

(57) ABSTRACT

A seagoing vessel having within its hull a plurality of longitudinally placed structural tubulars running the length of the tubeship. The tubulars are placed side by side and attached to each other and to the underside of the tubeship deck. According to one design, the tubeship hull is constructed upside down, layer by layer.

20 Claims, 15 Drawing Sheets

TUBESHIPS, AND SYSTEMS AND METHODS OF CONSTRUCTING

CROSS-REFERENCE TO RELATED APPLICATIONS

Not applicable.

TECHNICAL FIELD

This disclosure generally relates to seagoing vessels and systems and methods for constructing the seagoing vessels, particularly for ships and vessels having within their hulls a plurality of tubulars.

BACKGROUND OF THE INVENTION

Modern day shipbuilding techniques generally consist of pre-fabricated block hull construction, where multi-deck segments of the hull or ship superstructure are built in designated locations of a shipyard and then transported by large transporter and installed by heavy-duty cranes to be welded together. This method is known as block construction.

In block construction, large segments of the ship constructed of steel structural plates are assembled and outfitted with equipment, electrical, and utilities into building blocks called modules. These massive modules are then moved or lifted and joined together in what is known as the ship assembly area. This system turns out to be more efficient than assembling the whole structural shape first followed by outfitting with equipment, electrical, and utilities later. The open modules save man-hours by allowing easier access to the conduit for utilities and space for the equipment.

In conventional shipbuilding, ships are built in an upright position supported by chocks to support the irregular shapes of the ships during construction in the dry dock. Plate assemblies, including stiffeners for either the external form or internal bulkheads are built in automated plate shops. These plate shops are equipped with automated cutting, fitting, and welding equipment. The plate assemblies are built to the largest size that can be transported and lifted into place to form the interior of the ship's structure. Plate assemblies are moved on specially designed hydraulic actuated carriers in the largest sizes possible to the ship assembly area. Plate assemblies are lifted by large overhead cranes to be fitted and welded into the modules being assembled.

As girders, decks, beams, and bulkheads are positioned and welded into place, holes for utilities are cut and installed, or, if they were cut in prefab, holes are aligned. Conduits are placed and affixed to the plates and utilities are run during or after construction of the module.

Next the hull exterior is lifted into place with cranes on chocks and welded together. Interior bulkheads are welded to the external shells to complete the ship's structure. For streamlined ships, the plates must be lifted into place and held on the underside of the hull and then welded. As the modules are completed, they are then transported out to the ship assembly area on massive transporters.

As plate assemblies are positioned and welded into place, holes for utilities are cut or aligned. Conduits are then placed and affixed to the plates. Utilities and product piping are run during or after construction of the module. Utilities must be made watertight during this process.

While block construction results in numerous improvements over the older piecemeal methods of naval architecture and shipbuilding, it too has drawbacks. Conventional ship hulls are assembled using flat plates stiffened with structural shapes as plate subassemblies. The exterior of the ships as well as internal bulkheads use this basic building design. The entire ship must be designed and detailed to address all the stresses induced from its operations in all sea states. In a typical ship, there are thousands of individual plates to be designed as part of the overall plate subassemblies. Not only do current shipbuilding practices cause complex penetration and stress issues for utilities, but the individual shapes of plates must be cut and assembled to form the ship structure, which is a time consuming process. Additionally, block modules weigh thousands of tons and require large transporters and cranes.

A need exists for a new ship design that reduces the engineering design, detailing, and fabrication complexities required in conventional shipbuilding as well as improves the stress profile of a ship.

BRIEF SUMMARY OF THE INVENTION

Disclosed herein is a tubeship and a method for construction thereof. A tubeship is a seagoing vessel having a hull, a deck, and a plurality of tubulars oriented lengthwise within the hull. Tubulars can have a wide range of diameters, for example from less than a foot to 50 feet or more. According to one embodiment, tubulars are placed within the hull side by side in various configurations to make up a particular hull geometry. Tubulars, according to the present design, provide the bulk of the longitudinal and compressive strength. More importantly, tubeship design drastically simplifies the construction of a seagoing vessel. As described herein, tubeships can be fabricated upside down in a dry/wet-dock. Tubulars of varying diameters are welded into place on a deck that is oriented upside down. If desired, support spacers can be interlayed laterally between the tubulars to provide additional support and to provide manways through the tubulars. Support spacers can also house utilities and other equipment.

For upside down construction, after tubulars are positioned according to the preferred geometry, external hull skin is simply set upon the tubulars and welded in place, using gravity to hold it in place. Tubulars may be welded to the deck and to each other. In one embodiment, tubulars are welded to each other exterior to exterior, in a continuous fashion. This provides additional strength and torsion resistance. Tubulars can provide buoyancy, space for cargo, or they can be used to run utilities. In fact, in some designs, entire engine assemblies are placed within large diameter tubulars. Tubulars of various diameters and configurations are placed side by side throughout the hull. In one embodiment, the hull is built upside down from the deck to the keel by positioning and welding layer of tubulars upon layer of tubulars. Other configurations are possible. For example, layers of tubulars can be pre-fabricated and then floated into place above or below another layer of tubulars. When the tubulars are positioned and welded, and the hull skin is placed, the dry/wet-dock is flooded and the entire hull is rotated 180 to an upright position, at which point further outfitting can proceed.

According to the present design, tubeships can be constructed using significantly fewer man hours. In addition, the need for large transports and heavy duty cranes is reduced or eliminated. For example, in one embodiment, tubulars are floated into place in a wet-dock that is then drained so that the tubulars can be welded into place.

Tubulars may be fabricated onsite. Depending on the shell thickness, tubulars of large diameter may sag under their own weight. In those situations, tubulars are fabricated with internal stiffeners in various forms, such as I-beams, T-stiffeners, Z-purlins, or even spar stiffeners. According to the present disclosures, tubulars are rolled in a spiral pipe fabrication process. This involves inserting plate at an angle into a plate roller to produce spiral rolled tubular shape.

Large metal plates enter a spiral tubular assembly system, where they are skelp end welded together as needed. Offset forming rollers roll metal plates into a spiral tubular form, so as to fashion a continuous rolled tubular. Automated welding devices or manual welders weld the spiral seam as needed. Tubulars can be cut off when they reach the desired length. According to this design, tubular segments do not need to be lined up to be circular welded. The welders, in fact, remain in the same locations, in one embodiment, and the tubular is rotated through the assembly. This design also allows for minimal or no fit-up, and also allows for automated welding with fewer welds, and welds are not crossing over each other.

According to one embodiment, there is disclosed a seagoing vessel comprising a hull, a deck, a plurality of tubulars oriented lengthwise within the hull, wherein the tubulars run the length of the hull, and wherein the tubulars comprise an external surface, at least one weld between the external surfaces of at least two of the plurality of tubulars, and at least one weld between the deck and the external surface of at least one tubular. The aforementioned weld may also be continuous along the external surfaces of the at least two of the plurality of tubulars. In one embodiment, the seagoing vessel further comprises a support spacer positioned between at least two of the plurality of tubulars. The support spacer may conform to the curve of the external surface of at least one tubular. In one embodiment, the seagoing vessel further comprises a stiffener within at least one of the plurality of tubulars, wherein the stiffener is selected from the group consisting of tubular stiffener, spar stiffener, and spiral stiffener. The tubulars may also comprise bulkheads to seal the tubulars, and the bulkheads may also comprise bulkhead rollers, and may also comprise closure bladders.

In one embodiment, the seagoing vessel comprises a doubler plate welded to the external surfaces to at least two of the plurality of tubulars, at least one weld between the doubler plates of the at least two of the plurality of tubulars, and at least one weld between the deck and the external surface of at least one tubular.

A method for constructing a seagoing vessel is also herein disclosed, comprising assembling a vessel deck upside down in a dry/wet-dock, positioning a plurality of tubulars on top of the upside down deck, welding at least two of the plurality of tubulars to the upside deck, welding at least one of the tubulars to at least one of the other tubulars, affixing external hull skin onto at least one tubular. Positioning may comprise partially flooding the dry/wet-dock and floating the plurality of tubulars into position. Furthermore, the step of affixing may further comprise welding to the interior of the external hull skin a support spacer, resting the external hull skin on the plurality of tubulars, and welding the external hull skin to the plurality of tubulars.

The foregoing has outlined rather broadly the features and technical advantages of the present disclosure in order that the detailed description that follows may be better understood. Additional features and advantages will be described hereinafter which form the subject of the claims herein. It should be appreciated by those skilled in the art that the conception and specific embodiments disclosed may be readily utilized as a basis for modifying or designing other structures for carrying out the same purposes of the present designs. It should also be realized by those skilled in the art that such equivalent constructions do not depart from the spirit and scope as set forth in the appended claims. The novel features which are believed to be characteristic of the designs disclosed herein, both as to the organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present invention, reference is now made to the following descriptions taken in conjunction with the accompanying drawing(s), in which.

DETAILED DESCRIPTION OF THE INVENTION

Disclosed herein is a tubeship 100, and a method for building. Tubeship 100, in the preferred embodiment, is characterized by multi-sized tubulars running the majority of the length of the ship through the hull to form the structural shape and strength. Tubeships 100 offer numerous benefits over conventional shipbuilding techniques. For example, the modular design enables the same standard component to be used for a myriad of designs encompassing all types of ships. This reduces the overall shipbuilding costs over conventional techniques. The tubular design provides structural strength, while reducing or eliminating a large majority of individual plates. It also drastically reduces the cost of cutting, fit-up, and welding of these plates. Because tubulars run the majority of the length of the ship, utility installation costs are also reduced, which means manpower is reduced.

More importantly, tubulars can be fabricated and laid in place faster than conventional flat plates, thus significantly reducing the ship assembly time. Likewise, engineering associated with the design of a given ship is simplified and the need for large capacity transporters and cranes is reduced, or in some cases eliminated.

Figure 15B:
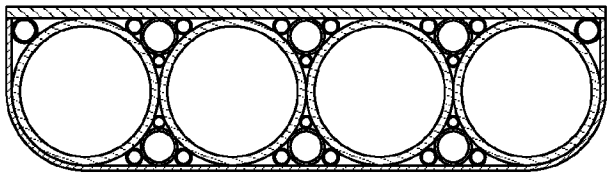
FIGS. 15A-D represents examples of types of hulls that can be constructed as tubeships.
Figure 15D:
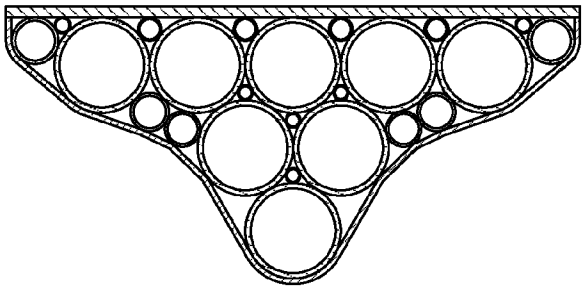
Figure 15A:
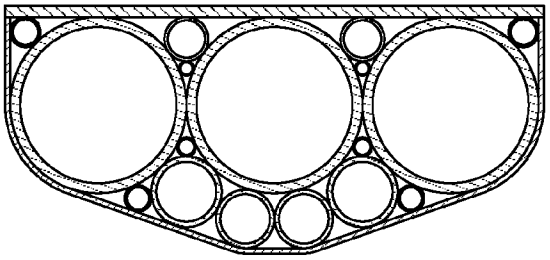
Figure 15C:
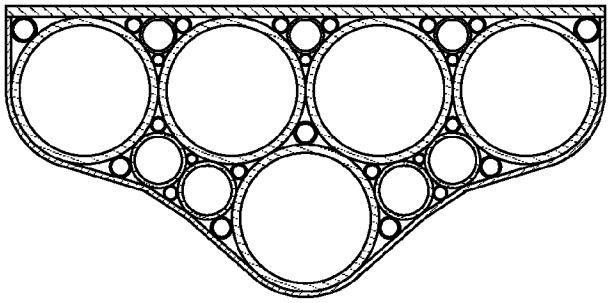

FIGS. 1A-D show an embodiment of the design according to the present disclosure, and represent four possible cross sections of a tubeship hull 200. Many different hull configurations are contemplated, such as tugs/supply vessels, flat bottom barges, shipshape vessels, and high-speed vessels such as naval vessels. In the embodiments shown in FIGS. 1A-D, hull 200 represents a streamlined hull for faster ships, such as naval vessels. Hull 200 is constructed by placement of various sized tubulars within hull 200 in a configuration to create the hull shape as shown in FIGS. 1A-D. FIGS. 15A-D show other hull shapes as contemplated herein. For example, FIG. 15A shows an example of a hull for tug or supply ship. FIG. 15B represents an example of a flatbottom barge hull. FIG. 15C demonstrates a shipshape example. FIG. 15D is an example of a naval vessel. Other ship configurations are contemplated, such as floating production storage and offloading vessels. Some boats are also contemplated within the tubeship design, such as large submarines.

Various hull configurations are created according to the placement of multi-sized tubulars, as shown by example in FIGS. 15A-D The hull design in FIGS. 1A-D, for example, contains seven to eight large tubulars, a multitude of medium tubulars, and several small tubulars. In the preferred embodiment, the tubulars run the majority of the length of the ship, not just through the cargo section. Tubulars, according to one embodiment, are welded together along the length of the external skin of the tubulars. They may be welded continuously, for additional structural rigidity, or skip welded at various intervals.

Figure 1A:
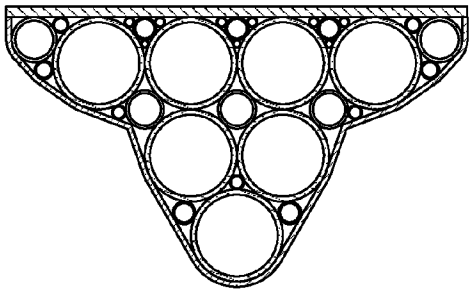
FIGS. 1A-D represent the cross section of a tubeship hull, according to one embodiment.
Figure 1B:
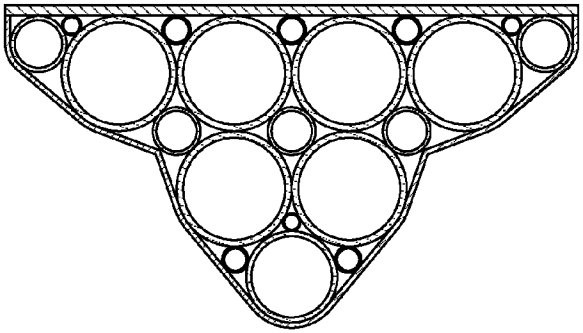
Figure 1C:
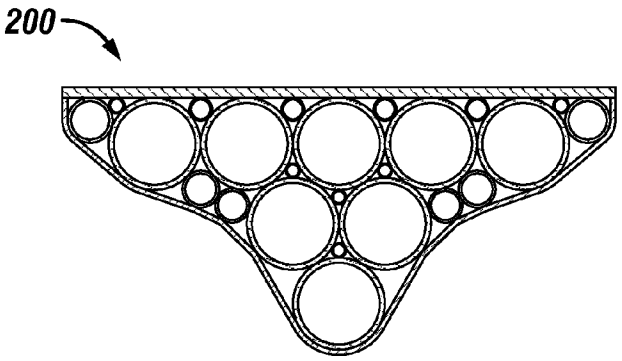
Figure 1D:
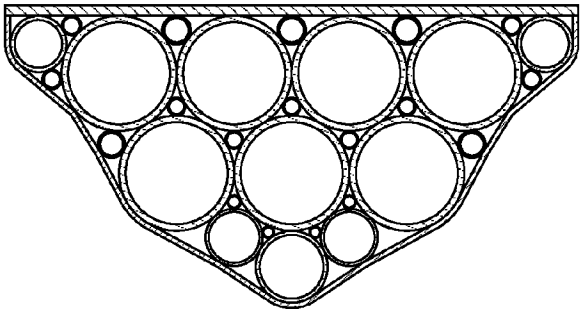
Figure 2:
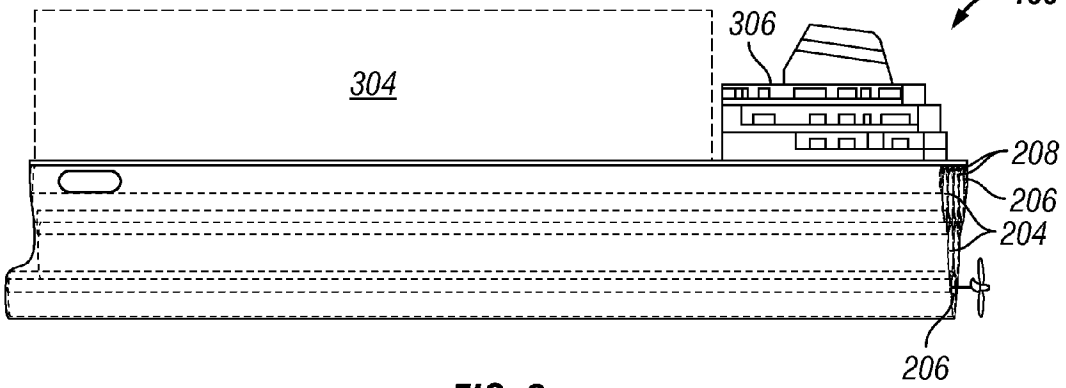
FIG. 2 is a side view of a tubeship.

FIG. 2 represents one embodiment of the present design as seen from the side view. Tubulars 202, in this embodiment, run the majority of the length of the ship, constrained by the angles of the skin panels. According to one embodiment, described in better detail below, the engine compartment and ship mechanicals may be located inside the center of one or more tubulars 202. In the embodiment shown in FIG. 2, tubulars 202 occupy the length of the tubeship 100, meaning tubulars 202 traverse from the bow to the stern with the exception of curved regions of tubeship 100 where said tubulars 202 cannot fit. One skilled in the art would understand that a tubular of a certain diameter must terminate at the location of a curved ship where the tubular can no longer fit. See bow and stern regions of FIG. 2. According to this embodiment, tubulars 202 are not constrained to the cargo portion of a ship, but instead traverse the lengthwise portion of tubeship 100. In the tubeship 100 embodiment shown in FIG. 2, deck house 306 sits toward the rear of the ship, with deck cargo area 304 located toward the front.

Tubeship Construction

A tubeship 100, according to one embodiment, is constructed unlike any ship in existence. For example, the hull 200 can be built upside down. In conventional shipbuilding, ships are built in an upright position supported by chocks designed to hold the irregular hull shapes during construction in the dry-dock. A tubeship, in contrast, is constructed from the deck to the bottom of the keel. According to one construction method, the deck 302 is first constructed to run the length of the ship and placed on the floor of the dry/wet-dock upside down. See FIG. 11 As used herein, a dry/wet-dock is an enclosed area used for storing, loading, unloading, building, or repairing ships. The dry/wet-dock is capable of serving as a dry-dock and then subsequently flooding to become a partially to fully filled wet-dock.

Figure 3:
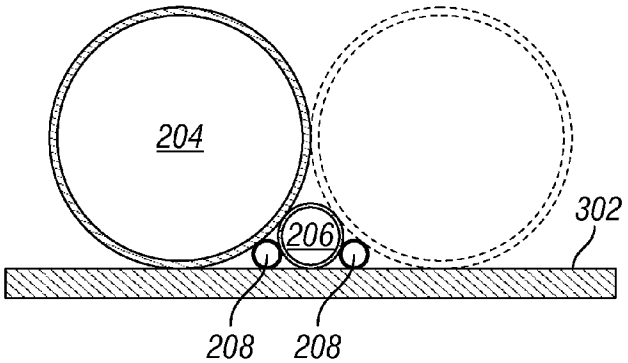
FIG. 3 is a cross section of a tubeship hull during construction.

After deck 302 is assembled upside down on the floor of the dry/wet-dock, tubulars 202 are then laid in place and welded to deck 302. Depending on the size of tubulars 202, smaller tubulars may be placed in between concurrent large tubulars. For example, in FIG. 3, large tubular 204 is placed on deck 302 and welded into place. Medium tubulars 206 are then positioned next to large tubular 204. They are welded to deck 302 and to large tubular 204. If additional rigidity is desired, or if extra utility or product conduits are preferred, small tubulars 208 may fill the spaces between, as shown in FIG. 3.

Figure 4B:
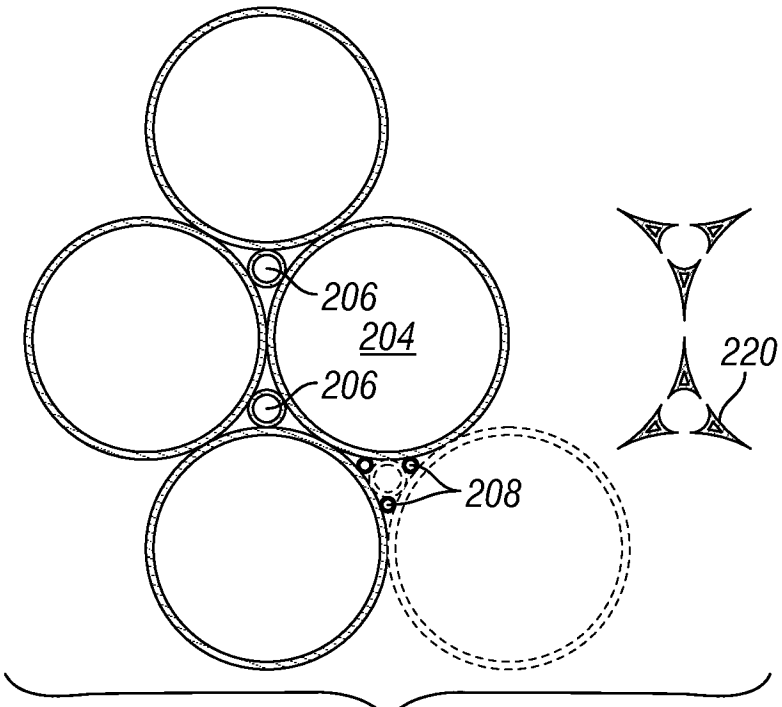
FIGS. 4A-B show a cross section of tubulars having support spacers.
Figure 4A:
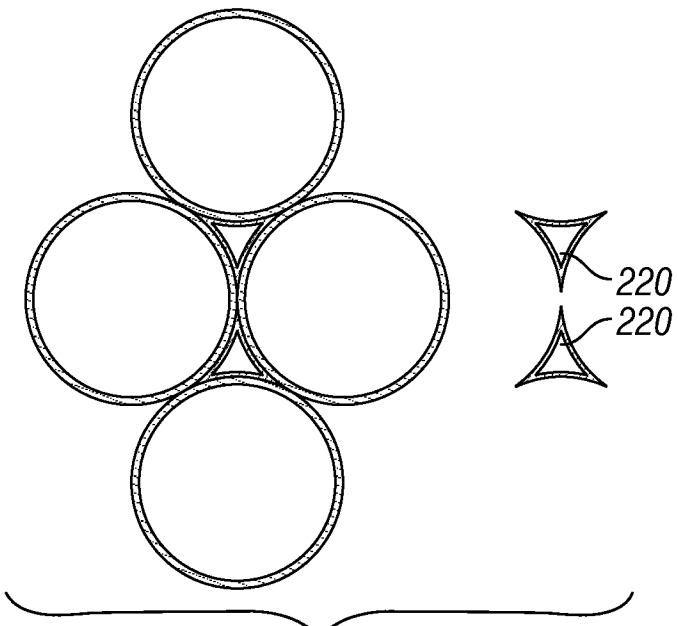

According to one embodiment, tubulars 202 can be joined directly together by welding. For example, welds can be placed longitudinally where the tubulars 202 meet. In addition, other elements described herein support connection between tubulars 202. In one embodiment, support spacers 220 are placed between tubulars 202. Support spacers 220 can also be referred to as support stiffeners or stiffeners. FIGS. 4A and 4B show embodiments of support spacers 220 for various tubular 202 configurations. For example, in FIG. 4A, support spacers 220 are used between four tubulars 202 of like size, and therefore take a symmetrical form. Support spacers 220 can serve three roles. First, they help orient and separate tubulars 202 for known geometry. Second, they support the tubulars. And third, support spacers 220 transfer forces between tubulars. Support spacers 220 may run the entire length of tubulars 202, but may also be placed only at certain increments. For example, for a tubular of 500 foot length, support spacers 220 may be placed every 50-100 feet. Support spacers 220 need only be of certain length of provide support to tubulars 202. For example, they can range from a fraction of a foot in length, to several feet in length, to continuous spacers that run the entire length of tubulars 202.

FIG. 4B shows tubulars 202 of differing diameters, such as large tubulars 204 and medium tubulars 206. Support spacers 220, therefore take non-symmetric shape to account for the spaces between the collective tubulars. For the configuration shown in FIG. 4B, multiple support spacers 220 are contemplated. According to one embodiment, during construction, tubulars 202 are rolled or floated into place (as described below) and set in place. Support spacers 220 are then laid on top of the working layer of tubulars 202 and subsequently welded into place. Support spacers 220 may be fashioned from steel or other metals and may be solid in nature. Preferably, however, support spacers are steel structures having an open center region to allow for utilities or passage by humans or tools/robots. As shown in FIG. 4B, additional small tubulars 208 may be further situated between large tubulars 204 and medium tubulars 206, such as where watertight utilities are run along the length of the tubeship 100. Where small tubulars 208 are used, tubulars 208 may substitute for support spacers 220 regarding the load and support. In other embodiments, smaller support spacers 220 are still used between large, medium, and small tubulars.

Figure 5B:
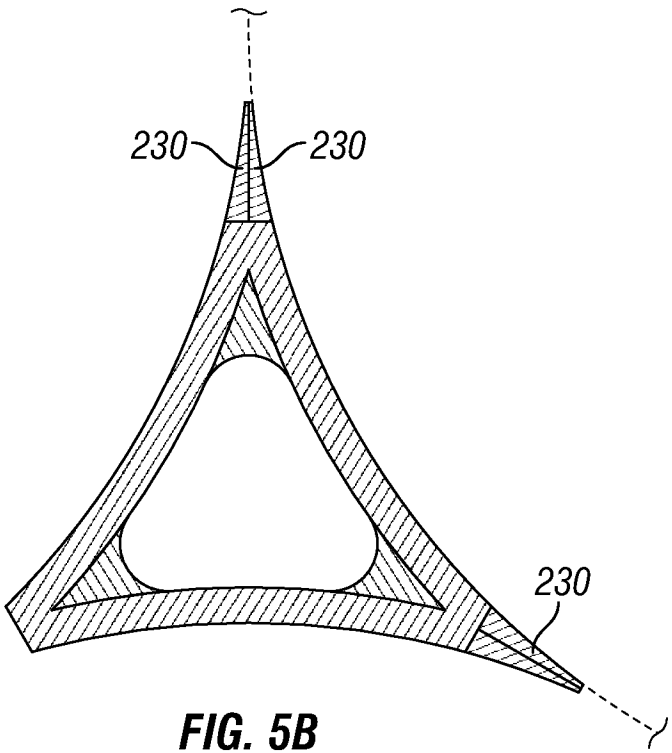
FIGS. 5A-B show one embodiment of a support spacer with doubler plates.
Figure 5A:
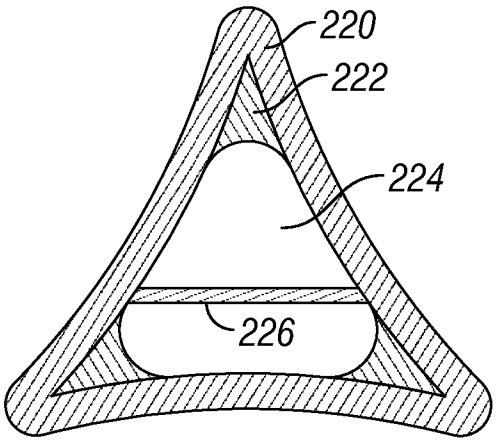

According to one embodiment, support spacers 220 are designed to conform to the shapes of the tubulars 202 in their final position. The frames of support spacers 220 are standard designs that can be constructed by either welding steel shapes, or by using large hydraulic presses to form support spacers 220 into the geometrical support shapes. FIG. 5A depicts a support spacer 220 according to one embodiment. Angle support 222 can be fitted into the portion at the vertex of support spacer 220 for additional structural capability. This leaves manway 224 open for the running of utilities or for passage by service persons. The embodiment of FIG. 5A also shows a support tray 226, which can be used to hold utility pipes, product piping, or other devices that traverse the length of tubeship 100.

One of the benefits of the present design is the low man-hours required to build tubeships. Tubeship repeated geometry enables standard joining components, with minimal fit-up times. Because the tubular connections are linear, welding can be automated with translating welding robots on tracks, or by moving tubulars 202 through a welding station. In addition, standardized tubular 202 sizes can be used in multiple tubeship designs, further automating the construction of multiple vessels.

Figure 11:
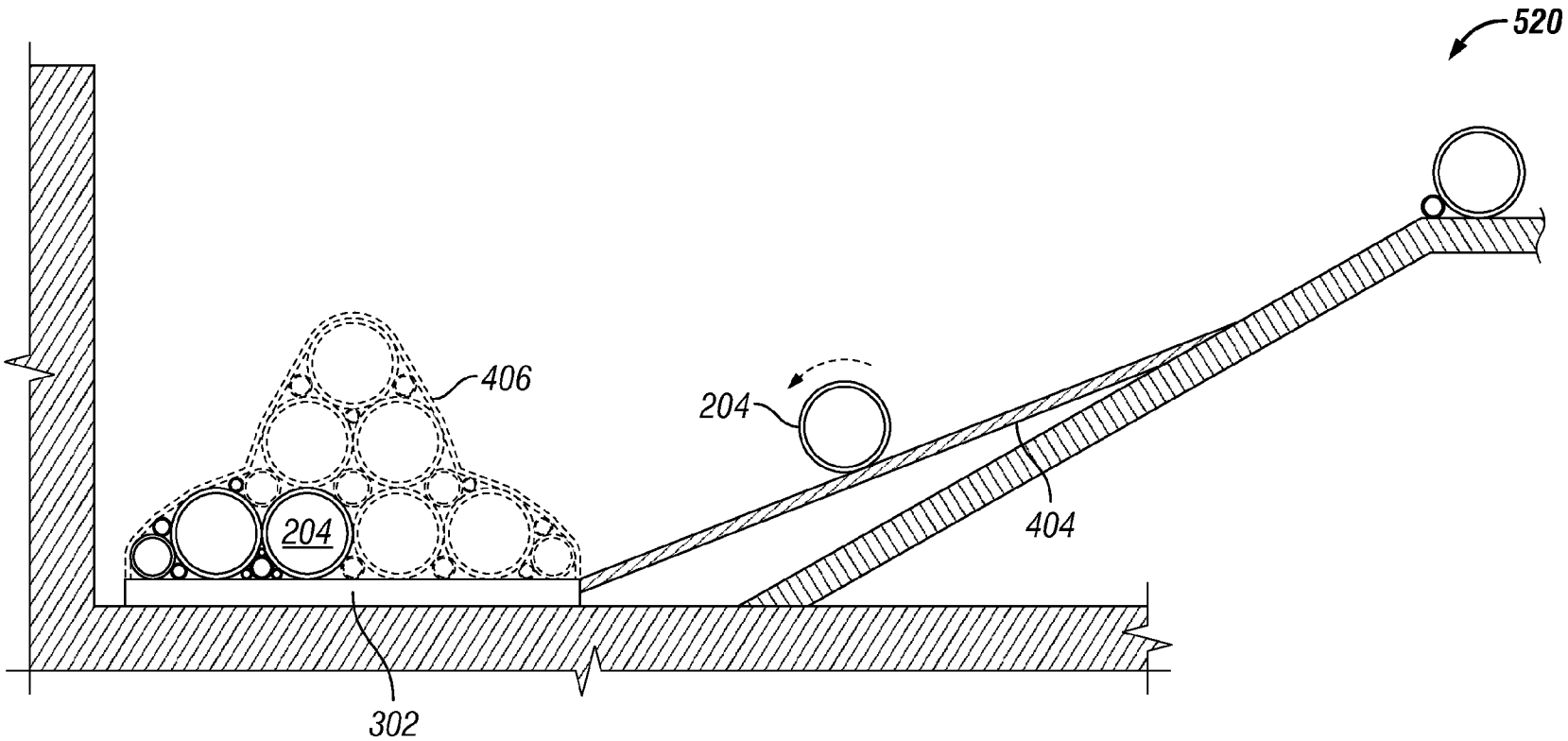
FIG. 11 is one embodiment of a tubeship during construction.
Figure 12:
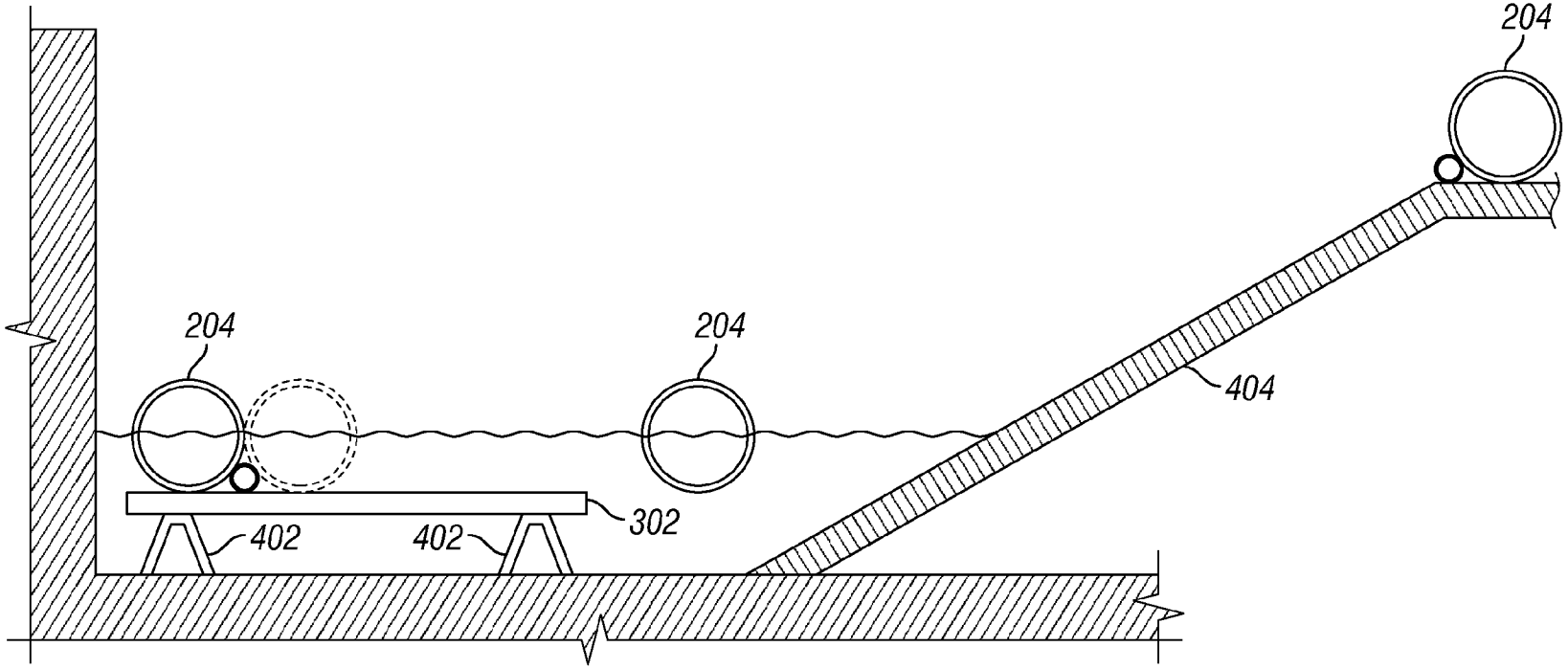
FIG. 12 shows another method of tubeship construction.

Ships can weigh thousands of tons, and conventional shipbuilding requires large transporters and super heavy duty cranes to move and install segments. According to the present design, cranes of this magnitude would not be required. In one embodiment, the tubeship hull is built upside down in a dry/wet-dock, as shown in FIG. 11. Deck 302 is assembled and placed upside down in the dock. For access to what will eventually be the upper side of deck 302 (lower side in FIG. 12), deck supports 402 can be used. Tubulars 202, including large tubulars 204, medium 206, and even small 208 are fabricated on a higher level than, or even with, the floor of the dry/wet-dock and therefore can be rolled into place on deck 302 via ramps 404. When they are correctly placed, they can be skip welded to hold their position while additional tubulars are placed. As described above, support spacers 220 can be placed in between to assist in proper placement. Then automated welding devices, such as robots on tracks or wheels, weld tubulars 202 to each other, or to support spacers 220, or to doubler plates 230. In the alternative, deck 302 can be situated on longitudinal rollers so that tubulars 202 and deck 302 can be longitudinally shifted through a fixed welding station. As one level of tubeship 100 is complete, tubulars 202 are then rolled into place on the next level, until the ship hull 200 takes its preferred shape, the examples of which are shown in FIGS. 15A-D.

In an alternate embodiment, tubulars 202 can be floated into place. See FIG. 12. According to this design, tubulars 202 (such as large tubulars 204) are capped at each end so that they maintain buoyancy. Dry/wet-dock is partially flooded so that tubulars 202 float, and can be easily moved into place using tubular buoyancy. When the tubular is positioned, the dry/wet-dock is partially drained so that the tubulars rest on the welding location, such as deck 302 or other tubulars 202. Tubulars 202 can be tack or skip welded to each other or to support spacers, or to doubler plates as described above. The wet-dock can also be fully drained if desired for better welding conditions.

Figure 13:
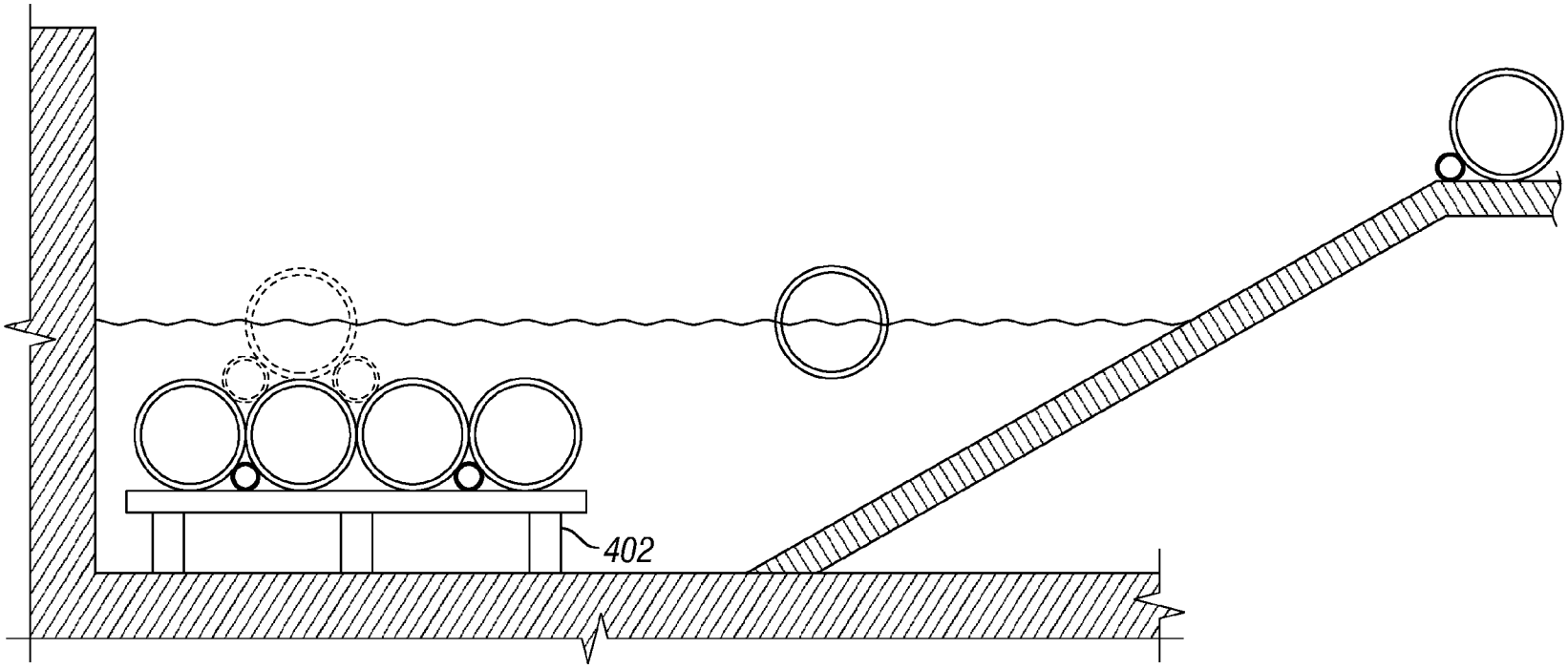
FIG. 13 shows a tubeship hull during construction.

When it comes time to add an additional level of tubulars 202, the lower level (in this case, the level closer to deck 302 because tubeship 100 is being constructed upside down) tubulars 202 are uncapped, or pierced, so that they flood when the dry/wet-dock is again partially flooded. See FIG. 13. An additional number of capped, buoyant tubulars 202 are floated into place, and the process is repeated. No heavy transporters or cranes are required in this design. Relying on the buoyancy of tubulars normally weighing thousands of tons, tubulars 202 can be effortlessly floated into position. Utilities, product piping, electrical and control conduits can be run as each level is completed, or after all tubulars are positioned. Drive engines and mechanical equipment can be added while the ship is still upside down. In some embodiments, utilities, engines, and/or mechanical equipment are fully or partially installed prior to positioning tubular 202 on deck 302. Where needed, only part of tubular 202 is flooded to protect installed equipment.

Alternative construction schemes exist. For example, in one embodiment, one level of tubulars 202 can be welded to each other so that it can float separately from deck 302. As the wet-dock is flooded, this tubular level floats at the top of the water. Partially flooded tubulars 202 are then rolled down ramp 404 into the water. Because they are partially flooded, these tubulars will partially sink so that they can be slipped underneath the tubular level that is floating on the surface of the water. A second level of partially flooded tubulars is then constructed and the dry/wet-dock is drained so that the original tubular level is set on top of the newer level. If desired, those two levels can be welded together and subsequently floated above the surface of the water as a third level is floated underneath.

In another embodiment, two levels of tubulars are constructed to float separately from deck 302, for example in another dry/wet-dock. This allows for more versatility in situations where certain tubulars 202 or levels of tubulars are not to be flooded. Engineers can flood certain tubulars in the level (or indeed matrix of tubulars) and thereby raise and lower the level accordingly. One skilled in the art would understand that several scenarios are available to place tubulars or levels/matrices of tubulars using buoyancy methods.

In conventional shipbuilding, the external skin is one of the primary structural components of the ship, especially with respect to longitudinal and compressive stresses. In the tubeship 100, by contrast, the tubulars provide the bulk of the longitudinal and compressive strength. The tubeship design also simplifies installation of a ship's exterior shell. In conventional shipbuilding, the exterior shell must be lifted and held into place on the underside of a suspended hull segment. This complicated process is not required for tubeships, which may be built upside down. Instead, the hull skin is simply lowered to rest on positioned tubulars 202. Gravity holds the skin in place and allows downhill welding. This also simplifies prep and painting of the external hull skin because the skin is below the spray, enabling automated painting which saves man hours in the painting application as well as reduces wasted paint. In one embodiment, support spacers 220 are pre-welded to the interior of hull skin 406. As hull skin 406 is lowered into place, support spacers hold hull skin 406 in place. Hull skin 406 can even be floated into place using attached floatation bladders. In another embodiment, spacers are welded to the exposed tubulars 202 and provide a receptacle for the external steel plate, which can be set upon the spacers and welded into place using automated equipment.

To move the entire tubeship 100, again no crane is required. Rather, the dry/wet-dock is fully flooded, and tubeship 100 is floated to the next stage of construction, for example to another dry/wet-dock or a deepwater protected area. When hull 100 is complete, tubeship 100 can simply be rotated along the x-axis 180 degrees so that deck 302 is on the top side of the ship. This revolutionary design eliminates a good portion of the heavy machinery required in conventional ship building techniques, also saving man-hours and costly assembly of multiple segments of ships.

Figure 16:
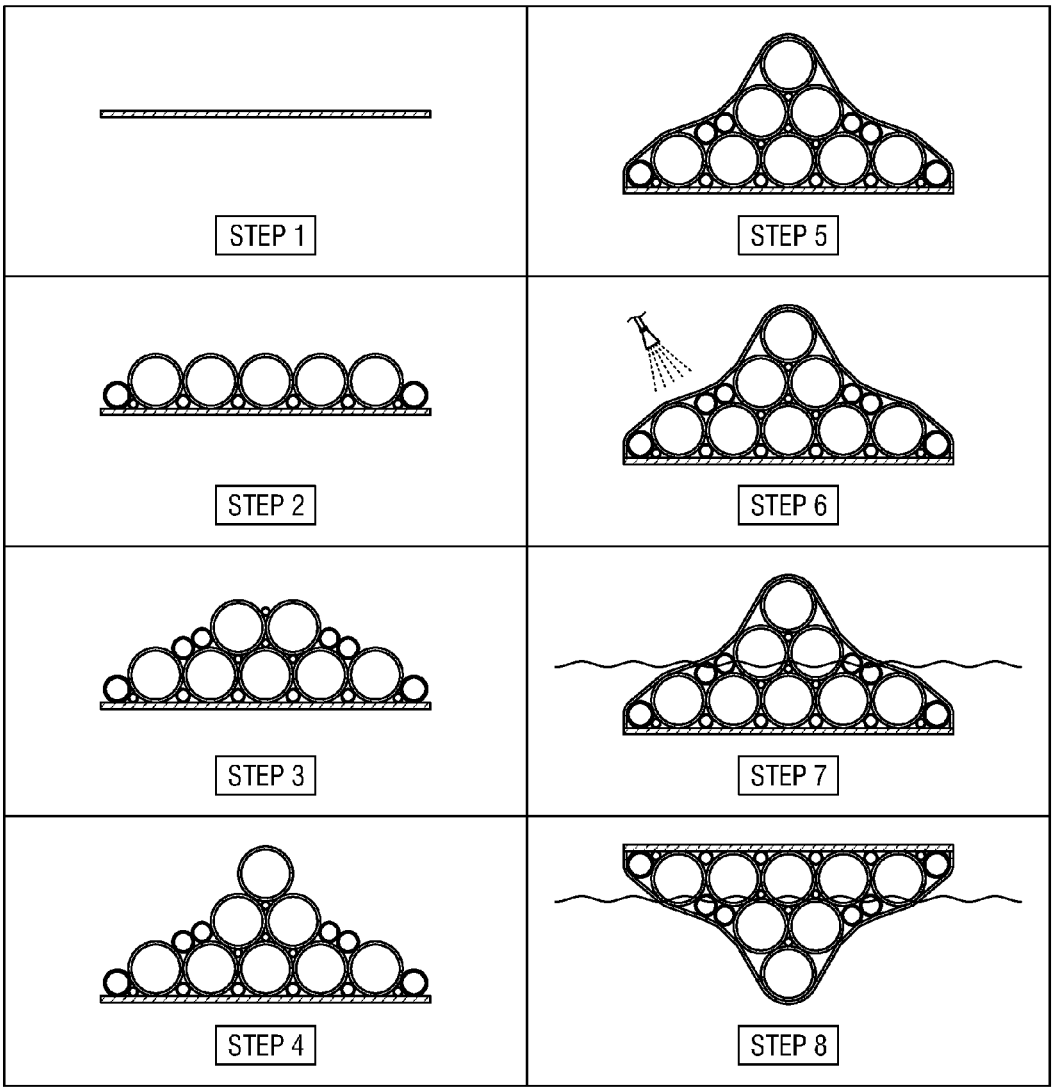
FIG. 16 shows one embodiment of a tubeship construction in dry/wet-dock.

FIG. 16 represents one embodiment of tubeship 100 construction. In step 1 top plate assembly 302 is assembled placed upside down in dry/wet-dock. In step 2, a series of tubulars 202 is positioned and installed on the underside of deck 302. Steps 3 and 4 show additional layers of tubulars 202 being installed. In step 4, the geometry of the hull is completed and external plating starts to be installed. In step 5, the hydrodynamic shape of the vessel is set in place with full external hull skin. Painting can then occur in step 6. The dry/wet-dock is flooded in step 7 so that tubeship 100 can be rolled 180 degrees into an upright position.

Figure 14:
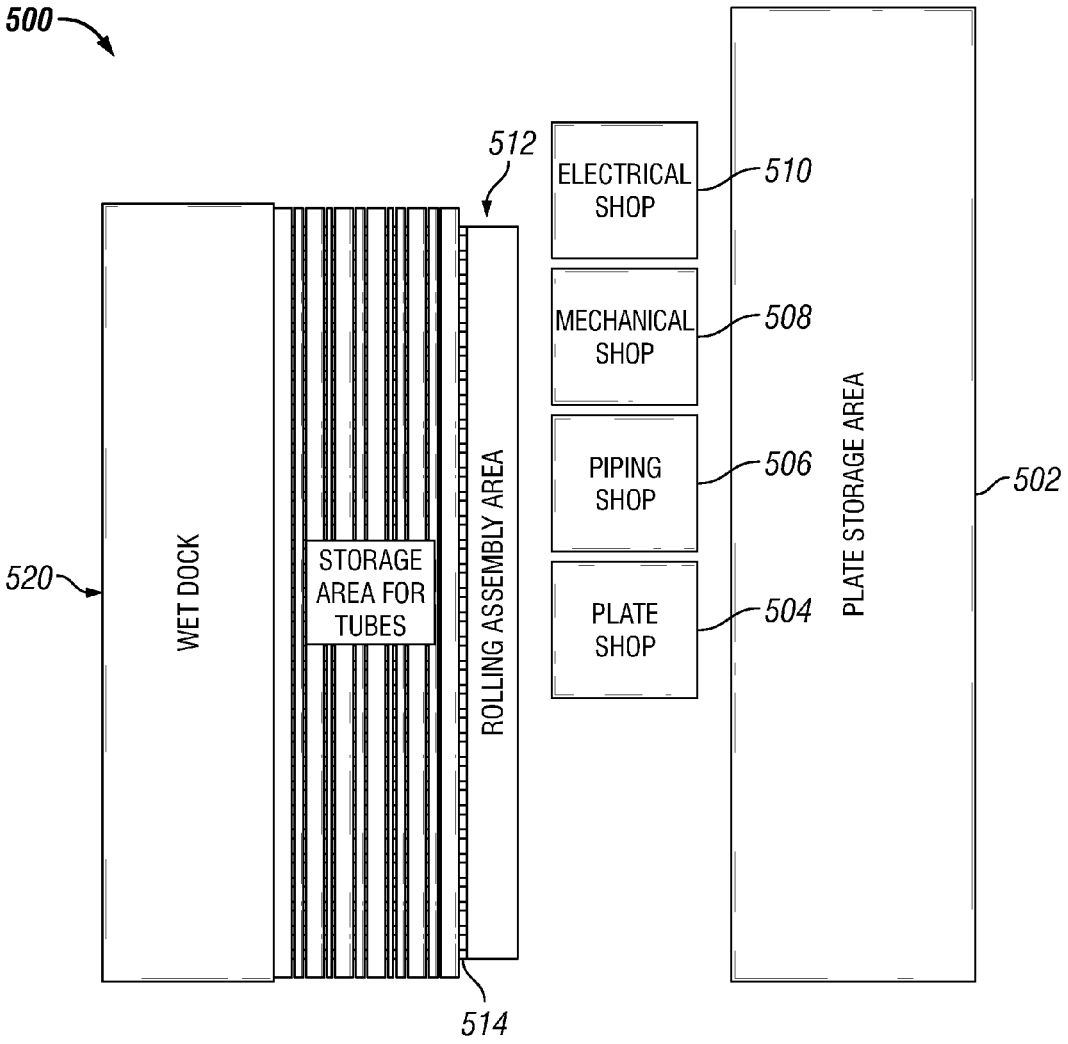
FIG. 14 represents one embodiment of a tubeship construction yard.

FIG. 14 shows an embodiment of a tubeship yard 500. As described above, tubeships 100 are fabricated in dry/wet-dock 520. According to this embodiment, tubeship yard 500 includes a plate storage area 502, plate shop 504 and piping shop 506. Plates of varying sizes and thicknesses enter rolling assembly area 512 where they are cut to the desired dimensions, prepped for bending, and are rolled into tubulars 202. If desired, tubulars 202 can be outfitted with utilities from parts in mechanical shop 508 and electrical shop 510. Tubulars are deposited into storage area 514. According to one embodiment, utilities can also be outfitted while tubulars 202 are stored in storage area 514. In one embodiment, storage area 514 corresponds to tubular ramp 404. In this scenario, tubulars are stationed along ramp on their way to dry/wet-dock 520, where they are sealed and prepared for floatation to deck 302.

Tubeship 100 design also provides for simplified bulkhead installation. For example, bulkheads are often desired at certain intervals to prevent the possibilities of water ingress or cargo egress due to an external breach. In addition, bulkheads can be used to strengthen the traverse direction of forces between the tubes and the stiffeners. According to one embodiment, bulkheads 310, consisting of flat plates of repeating geometry are prefabbed elsewhere. Bulkheads 310 are moved into the interior of tubulars 202 using large modified forklifts, where the bulkhead 310 is welded into place. In one embodiment, rollers 312 are placed on the edges of bulkhead 310 to assist in moving through tubular 202. In another embodiment, these rollers 312 themselves are mechanized to crawl bulkhead 310 into place until it reaches its destination. Bulkheads may be installed prior to, or after tubular 202 is installed in tubeship 100. If bulkhead 310 is installed prior to tubular 202 placement, then tubular 202 can be rotated to assist with welding of the bulkhead 310 to tubular 202.

Figure 10:
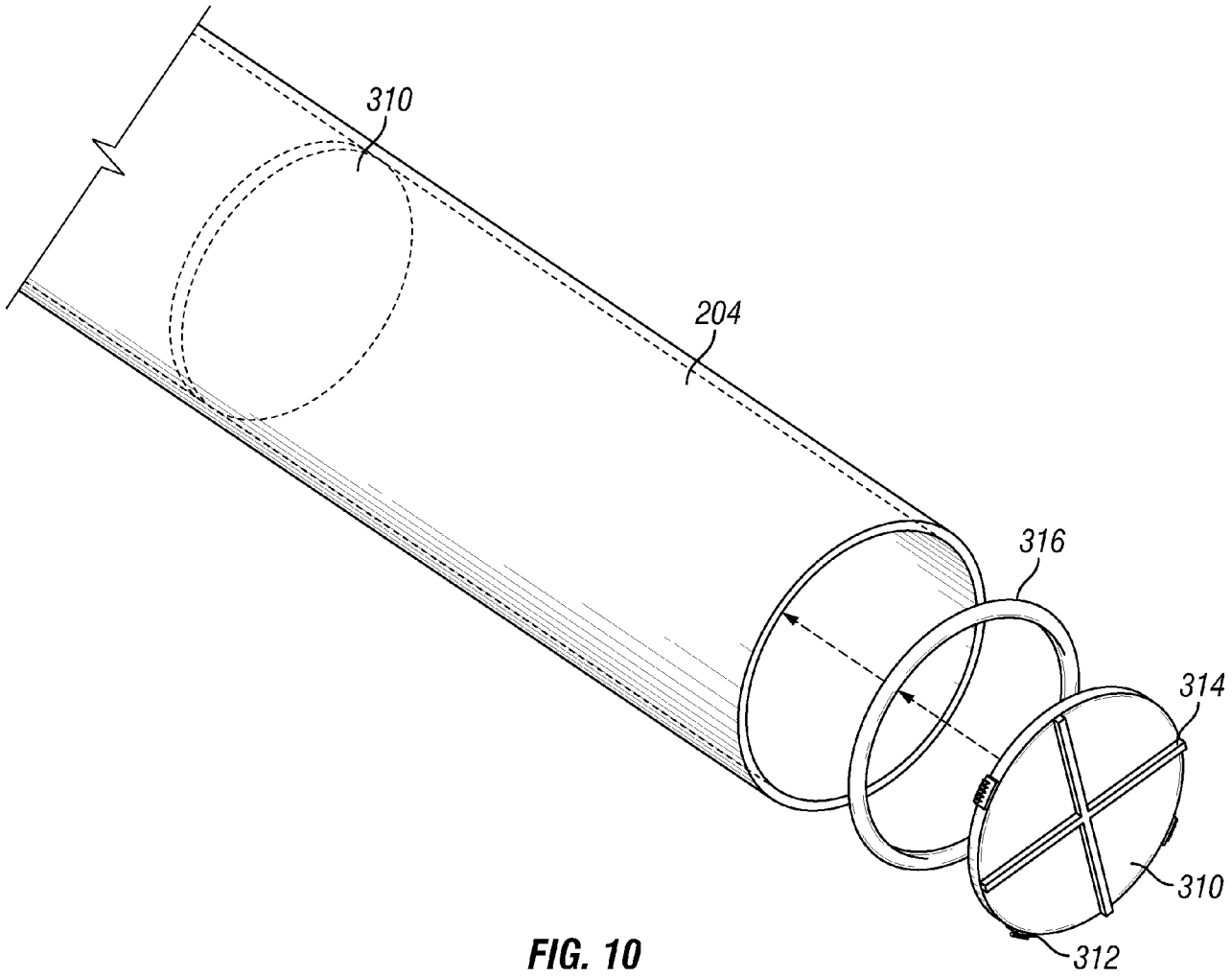
FIG. 10 shows one embodiment of a tubular bulkhead, according to the present disclosure.

Bulkheads 310 can either be added while tubulars 202 are being fabricated, or even after the fabrication is complete but prior to adding tubular end closures. Bulkheads 310 may be constructed of thick-walled metal, such as steel. In the alternative, bulkheads 310 may be thinner plate metal with bulkhead stiffeners 314 running throughout, as seen in FIG. 10. Bulkheads may also be corrugated or coned shaped. Because tubulars 202 are large in diameter, for floating and pressurization purposes, end caps or end closures are required. In one embodiment, end closures are similar to bulkheads 310, especially when it is desired that they be permanent. For tubeship 100 fabrication purposes, where tubulars 202 need only be floated for long enough to be correctly placed, more temporary end closures are contemplated. In one embodiment, for example, large plates having expandable bladders 316 are situated near the ends of tubulars 202. The bladders 316 are filled with fluid to form a seal against the interior of tubulars 202. Bladders or balloons 316 surround the large plate at its edge.

A significant advantage of tubeship 100 design is seen in the reduction of man-hours associated with utility installation. Most of the major distribution in a ship is longitudinal, while the minor distribution is vertical. In conventional shipbuilding, utilities run longitudinally are in segments penetrating the bulkheads, and must be later spliced into the corresponding utilities when the segments are joined together. This requires complex coding and marking schemes, as well as additional man-hours. According to the present design, entire longitudinal utility runs can be done at once, with fewer welds or splices. More importantly, in the present design, longitudinal distribution is run in smaller diameter tubing or open spaces that fit between the larger tubulars 202. Because the vessel is essentially built in "lifts" or levels, and because external hull plating is added last, utility piping can be installed in the open environment without the need for running through confined bulkheads. The equipment, utilities including electrical/instrumentation, product piping, and HVAC can be installed at each level as the tubes are installed.

Utility trays can be built as a secondary function into the support spacer 220 frames. It is possible to weld the utility piping and conduits at the end of the tube and pull them through the support spacer 220 frames and support them in place on the utility trays. Because these utilities are placed in the manways 224, they are easily accessible. In fact, in one embodiment, manways 224 don't require cumbersome bulkheads because, in the event of a breach, watertight tubulars 202 would still provide the buoyancy required to keep tubeship 100 afloat. Additionally, insulators and water sealants such as closed cell foam can be run between the large tubulars to prevent water ingress and provide proven buoyancy in case of a breach.

Where piping and electrical conduits need to penetrate tubulars 202, penetrating plates can be added to the interiors or exteriors of each tubular 202. Piping and electrical conduit are run through these penetrating plates and seal welded to prevent water ingress in the event of a breach.

In conventional shipbuilding, the engine and mechanical components are incorporated into the block modules during construction. With tubeships, it is envisioned that substantial outfitting can be performed on open tubulars 202 as they are fabricated and prior to enclosing and assembling together in the dry/wet-dock. As tubulars 202 are open, it is possible to install major equipment, electrical panels, distribution systems and some internal utilities inside tubulars 202 prior to adding the watertight bulkheads and end closures while they are stored on the storage racks prior to assembly. It is envisioned that up to 50% of the outfitting can be performed as tubulars 202 sit in storage prior to assembly. This can save significant man-hours and outfitting time over outfitting alongside the quay, and reduces the overall schedule significantly. In another embodiment, the mechanical can be added in the dry/wet-dock, either before or after uprighting.

Tubular Construction

Rolled tubulars 202 are the fundamental building blocks for Tubeships 100. Tubulars 202 are pre-engineered with known strength, stress, buoyancy, ballast, and other shipbuilding characteristics. The rolled tubulars 202 become the standard and modular building block components of tubeship 100, and can be assembled quickly and less expensively to meet numerous shipping designs. Tubulars 202 can be joined together to form various ship shapes from small tug/supply boats to the largest oil cargo ships or even naval vessels. Primary rolled tubulars 202 can be fabricated into many sizes, with diameters of 10, 15, 20, 25, 40, 50 feet and even larger. Metric sizes are also considered, such as diameters of 5, 10, 15, and 20 meters. Tubulars less than 10 feet can be commercially purchased as steel pipe, and do not require special rolling. Shapes larger than 10 feet, however, are generally not commercially available, and cannot be easily transported. For this reason, tubulars 202 can be fabricated near the assembly dry-dock for ease of transportation. There is presented herein certain novel designs for fabricating and manufacturing tubulars.

Conventional assembly of large diameter tubulars is performed by rolling metal plate segments to the desired diameter. The width of the rolled segments depends on the width of the rolling press, which is usually 10 feet or less in width. The rolled segments are removed from the roller and the longitudinal edges of the tubular are welded together to create the tubular. Then the edges of the rolled sections are welded together to form the overall tubular length. Larger tubulars can be constructed using modified rolling techniques.

For larger tubulars 204, especially, large diameter tubulars with thinner wall thicknesses can cause the tubulars 204 to sag under their own weight, which can erode the symmetry of the tubular. In one embodiment, therefore, doubler plates 230 are welded to the external surface of tubular 204. Doubler plates can take many shapes and sizes, but for example can be external plates of varying thicknesses and widths and run the length of the tubular 204. In one embodiment, doubler plates 230 are configured to rest on the edge of support spacer 220 as seen in FIG. 5B. Doubler plates 230 are welded to tubulars 204 either during or after the tubular fabrication process. Tubulars 204 are then rolled or floated into place so as to rest on the vertex edge of support spacer 220. Tubulars 204 can be properly oriented through the use of stabbing guides or stops, as well as through the use of doubler plates 230. Guides prevent tubular 204 from rolling during construction of tubeship 100. It also presents additional welding opportunities and provides a space for welders or robots to negotiate between tubulars for easier access to the welding locations. For example, because support spacers 220 do not necessarily run the entire length of the tubulars 202, welders can enter through manway 224 and then access the welding locations in the area between support spacers 220. This also applies to doubler plates 230. Welders can access the doubler plates 230 for each tubular 204 after the tubulars 204 that have attached doubler plates 230 are laid in place among support spacers 220. Doubler plates 230 can be space frames, having, for example, four plates welded together with a space in the middle. This allows for a more rigid doubler plate 230 with less material, and it enables robotic welding.

Figure 6C:
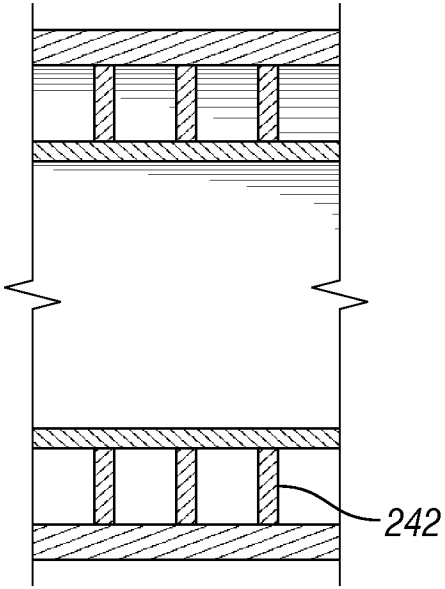
FIGS. 6A-C represent embodiments of different tubular configurations.
Figure 6B:
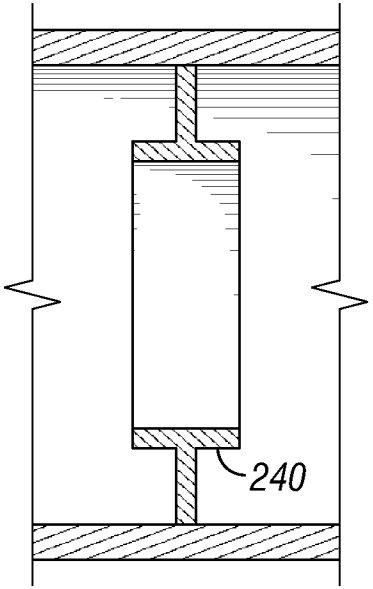
Figure 6A:
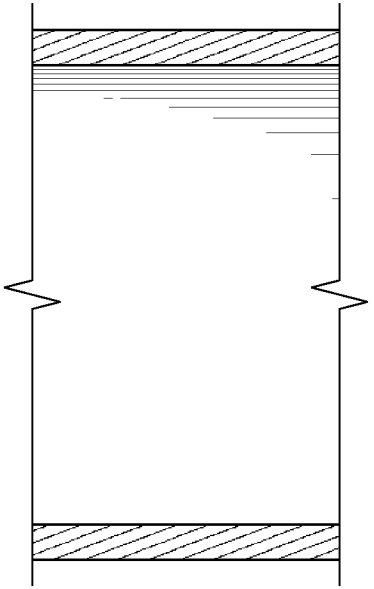

Other designs for combating tubular sag are herein contemplated. For example, in one embodiment, circular tubular stiffeners 240 are used. FIGS. 6A-C shows three versions of large tubulars 204. FIG. 6A shows a conventional tubular 202 having single tube design and no stiffeners. This design is suitable for small tubulars 208, but would likely require higher wall thicknesses for larger diameters. Large tubulars 204 may sag under their own weight, depending on the diameter of tubular 204 compared to its thickness. To improve the rigidity and reduce material, circumferential stiffeners 240 are employed. FIG. 6B represents a cross section of a tubular 202 having an internal T-shaped stiffener 240. In one embodiment, the T-shaped stiffeners 240 are placed at longitudinal intervals within tubular 202. In this design, stiffeners 240 take the form of a ring, essentially perpendicular to the longitudinal axis of the tubular. In this embodiment, one side of stiffener 240 attaches to the other. Stiffeners 240 can take the form of other shapes, such as a channel section, and I shape, or a Z-purlin shape.

In another embodiment of the present disclosure, large tubular 202 has embedded within it, a smaller tubular, such as a medium tubular 206, or a large tubular 204 with a smaller circumference. Spar stiffeners 242 then extend from the interior of the outer tubular to the exterior of the inner tubular, as seen in FIG. 6C. This composite tube design also resists sagging, but uses less material. Tubulars 202 need not be perfectly circular. In one embodiment, tubulars 202 can be oval in shape, depending on the preferred design.

Figure 7:
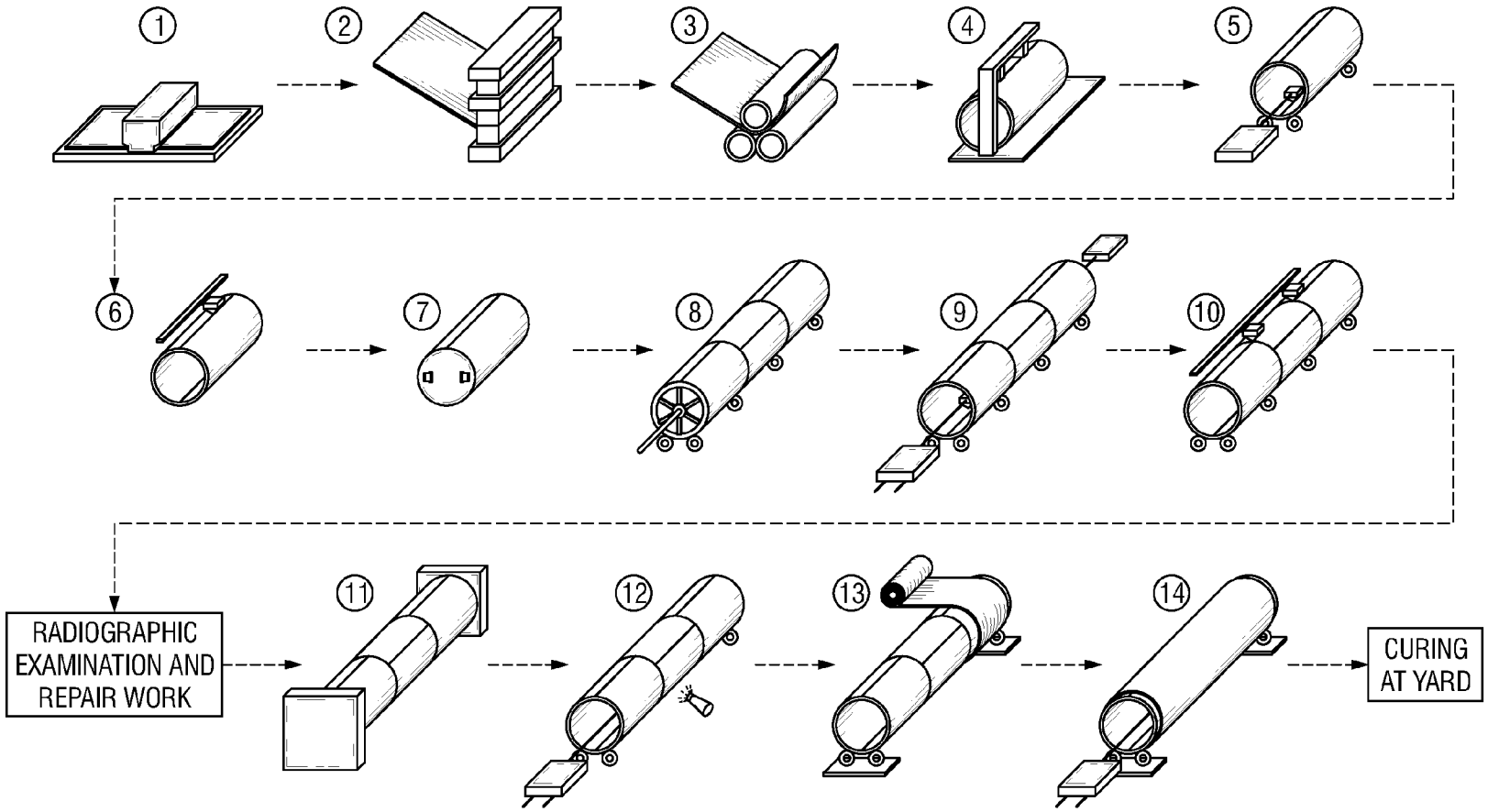
FIG. 7 shows a conventional tubular rolling method.

A typical conventional rolling technique, without the anti-sag fabrication methods described above, is shown in FIG. 7. Plates of metal, such as steel, enter rollers and are bend rolled into a cylindrical shape, where they are tack welded. From there, the longitudinal seam can be internal or externally welded. Each tubular segment is then placed end to end and circular welded together to form a longer tubular. The end is formed, and then the tubular is blast cleaned, primed, wrapped, and lined as necessary.

Figure 8:
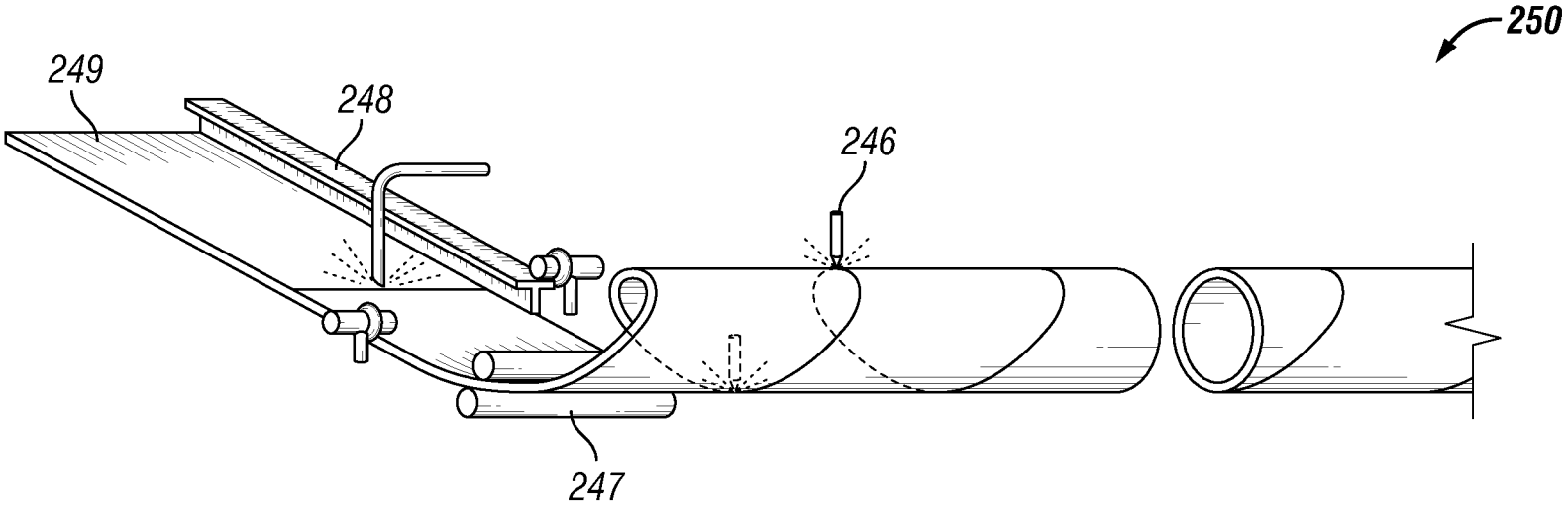
FIG. 8 shows spiral tubular assembly according to conventional methods for low diameter spiral pipe.

Even though straight rolling fabrication methods can be used to construct large and medium tubulars 204 and 206, several drawbacks exist, such as in cost and time. Plus, it is difficult to install anti-sag elements and align and weld rolled tubulars together. There is presented herein a new method of manufacturing tubulars 202 for use in devices such as tubeship 100. In this new method, rolled tubes are constructed using a spiral rolling technique similar to that used to produce low diameter spiral pipe. This involves inserting plate at an angle into a plate roller to produce spiral rolled tubular shape. FIG. 8 shows spiral tubular assembly according to conventional methods for low diameter spiral pipe.

For low diameter spiral pipe assemblies, such as the one shown in FIG. 8, metal plate 249 enters the spiral tubular assembly system 250 along guide rail 248. Offset forming rollers 247 roll metal plate 249 into a spiral tubular form, so as to fashion and continuous rolled tubular. Automated welding devices 246 or manual welders 246 follow the spiral seam with weld as needed. Tubulars 202 can be cut off when they reach the desired length. According to this design, tubular segments do not need to be lined up to be circular welded. The welders 246, in fact, remain in the same locations, in one embodiment, and the tubular is rotated through the assembly 250. This design also allows for minimal or no fit-up, and also allows for automated welding with fewer welds, and welds are not crossing over each other.

Figure 9B:
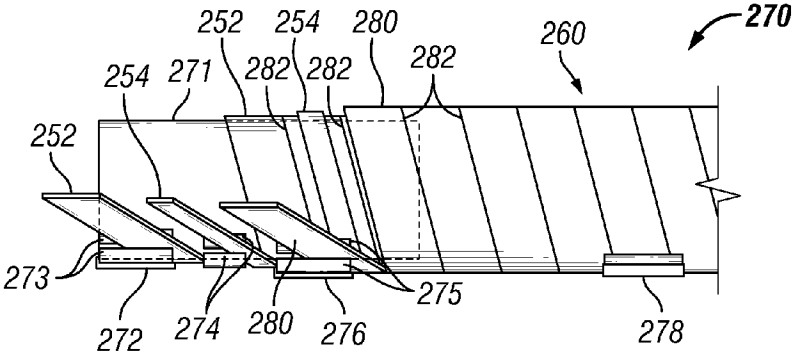
FIGS. 9A-C show a tubular assembly area, and represent one embodiment of spiral tubular manufacturing according to the present disclosure.
Figure 9C:
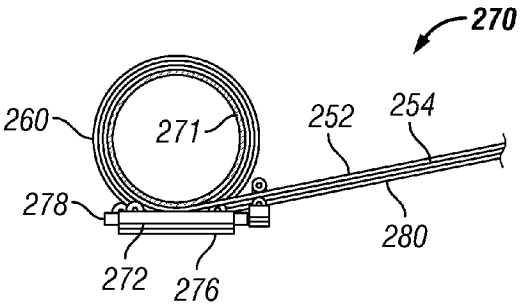
Figure 9A:
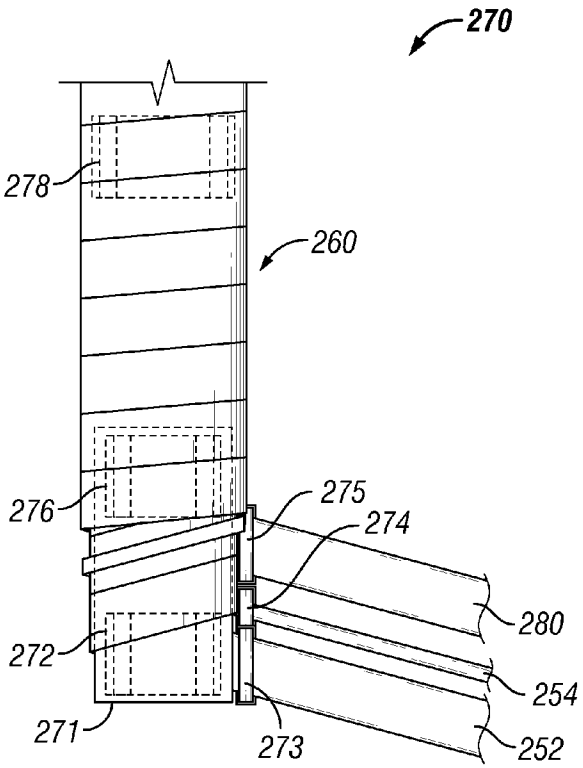

Conventional spiral tubular techniques are not suited for large tubulars 204 or, even in some cases, medium tubulars 206, where tubular size and weight make tubular sag an issue. Therefore, it is advantageous to incorporate anti-sag elements as discussed in relation to FIGS. 6A-C. FIGS. 9A-C show an alternative composite design, according to the present disclosure, utilizing a large tubular spiral rolling technique. First rolling plate 252 is fed into composite spiral tubular assembly system 270, where it contacts first bending roller 273 and is rolled into a pre-determined diameter to match large rolling template 271. According to the embodiment in FIGS. 9A-C, large rolling template is a heavy gauge steel cylinder having an outer diameter about the same as the inner diameter of spiral tubular 260. As seen in FIGS. 9A and 9B, large rolling template rests on first turning rollers 272 and second turning rollers 276. Large rolling template 271, in one embodiment, is a constant known diameter that turns as the first rolling plate 252 is rolled. The template supports the plate as it is rolled to a known diameter until the stiffeners are added. The large rolling template also aligns the edges of the plates together for easy assembly. Large rolling template 271 can extend far inside spiral tubular 260, or it can be of shorter length. In the embodiment of FIGS. 9A-B, large rolling template ends in length within the second spiral of third rolling plate 280. Large rolling template can have internal stiffeners (not shown) to ensure it does not deform.

As first rolling plate 252 is bent around large rolling template 271, the right most edge of first rolling plate 252 contacts the left most edge of an earlier section of first rolling plate 252. Hence, a spiral tubular 260 is made. Seams 282 are welded. Welding can be accomplished on the exterior by robotic welding prior to addition of spiral stiffener 254, or it can be accomplished on the inside of spiral tubular 260 later, after the seams clear large rolling template 271. Second rolling plate 254, which will take the shape of the spiral stiffener 254 is fed into the system through second bending rollers 274 alongside first rolling plate 252. It is rolled alongside plate 252 to either the same diameter, where it is welded to the side of plate 252, or a slightly larger diameter, where it is welded to the upper exterior of plate 252. Third rolling plate 280 follows, and, in the embodiment shown, spiral stiffener 254 is sandwiched between first rolling plate 252 and third rolling plate 280. Third rolling plate 280 enters system 270 to make contact with third bending rollers 275, where it is bent to a slightly larger diameter. In one embodiment, it is then welded to the exterior of spiral stiffener 254. Third rolling plate 280 assumes the position of the external shell of spiral tubular 260. Additional large turning rollers, such as third turning rollers 278 can be used to assist in the rolling of spiral tubular 260.

The composite spiral tubular assembly system presents a significant improvement to current tubular manufacturing technology, offering a stronger product with less material at longer lengths with fewer welds in an automated system. This subsequently results in reduced man-hours in fabrication. Another benefit is a double-wall vessel suitable for transport of liquid cargos. Also, in this design, the annulus between the two tubes can be thermally insulated for hot or cold cargos.

Although the present disclosure and its advantages have been described in detail, it should be understood that various changes, substitutions and alterations can be made herein without departing from the spirit and scope of the design as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A seagoing vessel comprising:

a hull;

a deck, having a length and a width, wherein the length is greater than the width;

a plurality of tubulars oriented in the direction of the length of the deck within the hull, wherein the tubulars run the length of the hull, and wherein the tubulars comprise an external surface;

at least one weld directly between the external surfaces of at least two of the plurality of tubulars; and at least one weld between the deck and the external surface of at least one tubular.

2. The seagoing vessel of claim 1, wherein the at least one weld is continuous along the external surfaces of the at least two of the plurality of tubulars.

3. The seagoing vessel of claim 1, further comprising a support spacer positioned between at least two of the plurality of tubulars.

4. The apparatus of claim 3, wherein the support spacer conforms to the curve of the external surface of at least one tubular.

5. The seagoing vessel of claim 1, further comprising a stiffener within at least one of the plurality of tubulars, wherein the stiffener is selected from the group consisting of tubular stiffener, spar stiffener, and spiral stiffener.

6. The seagoing vessel of claim 1, wherein the tubulars comprise bulkheads to seal the tubulars.

7. The apparatus of claim 6, wherein the bulkheads comprise bulkhead rollers.

8. The apparatus of claim 6, wherein the bulkheads comprise end closure bladders.

9. A seagoing vessel comprising:

a hull;

a deck, having a length and a width, wherein the length is greater than the width;

a plurality of tubulars oriented in the direction of the length of the deck within the hull, wherein the tubulars run the length of the hull, and wherein the tubulars comprise an external surface;

a doubler plate welded directly to the external surfaces of at least two of the plurality of tubulars;

at least one weld directly between the doubler plates of the at least two of the plurality of tubulars; and at least one weld between the deck and the external surface of at least one tubular.

10. The seagoing vessel of claim 9, wherein the at least one weld is continuous along the doubler plates of the at least two of the plurality of tubulars.

11. The seagoing vessel of claim 9, further comprising a support spacer positioned between at least two of the plurality of tubulars.

12. The apparatus of claim 11, wherein the support spacer conforms to the curve of the external surface of at least one tubular.

13. The seagoing vessel of claim 9, further comprising a stiffener within at least one of the plurality of tubulars, wherein the stiffener is selected from the group consisting of tubular stiffener, spar stiffener, and spiral stiffener.

14. The seagoing vessel of claim 9, wherein the tubulars comprise bulkheads to seal the tubulars.

15. The apparatus of claim 14, wherein the bulkheads comprise bulkhead rollers.

16. The apparatus of claim 14, wherein the bulkheads comprise end closure bladders.

17. A method for constructing a seagoing vessel, comprising:

placing a vessel deck upside down in a dry/wet-dock, wherein the vessel deck has a length and width, wherein the length is greater than the width;

positioning a plurality of tubulars on top of the upside down deck;

welding at least two of the plurality of tubulars to the upside down deck, wherein the at least two of the plurality of tubulars are oriented in the direction of the length of the vessel deck;

welding at least one of the tubulars directly to at least one of the other tubulars; and affixing external hull skin onto at least one tubular.

18. The method of claim 17, wherein the step of positioning comprises:

partially flooding the dry/wet-dock; and floating the plurality of tubulars into position.

19. The method of claim 17, wherein the step of affixing further comprises:

welding to the interior of the external hull skin a support spacer;

resting the external hull skin on the plurality of tubulars; and welding the external hull skin to the plurality of tubulars.

20. The method of claim 17, further comprising the step of installing a ship engine inside one of the tubulars.

* * * * *